US007027601B1

(12) United States Patent
Johnston

(10) Patent No.: US 7,027,601 B1
(45) Date of Patent: Apr. 11, 2006

(54) PERCEPTUAL SPEAKER DIRECTIVITY

(75) Inventor: James David Johnston, Warren, NJ (US)

(73) Assignee: AT&T Corp., New York, NY (US)

( * ) Notice: Subject to any disclaimer, the term of this patent is extended or adjusted under 35 U.S.C. 154(b) by 0 days.

(21) Appl. No.: 09/563,551

(22) Filed: May 3, 2000

Related U.S. Application Data

(60) Provisional application No. 60/156,483, filed on Sep. 28, 1999.

(51) Int. Cl.
*H04R 29/00* (2006.01)

(52) U.S. Cl. ..... 381/56; 381/123

(58) Field of Classification Search ..... 381/56, 381/1, 17–18, 98–103, 300, 309, 61, 123, 381/63, 310, 128
See application file for complete search history.

(56) References Cited

U.S. PATENT DOCUMENTS 4,118,601 A * 10/1978 Yeap ..... 179/1
4,454,609 A * 6/1984 Kates ..... 381/320
5,046,101 A * 9/1991 Lovejoy ..... 381/57
5,631,964 A * 5/1997 Harada et al. ..... 381/74
6,285,767 B1 * 9/2001 Klayman ..... 381/17

OTHER PUBLICATIONS

Jont Allen et al, "Micromechanical models of the cochlea" Physics Today, Jul. 1002, pp. 40-47.
Zoran Cvetkovic et al, "Tight Weyl-Heisenberg grames in $l^2(Z)$", IEEE 1998, pp. 1256-1259.

* cited by examiner

*Primary Examiner*—Duc Nguyen
*Assistant Examiner*—Lun-See Lao
(74) *Attorney, Agent, or Firm*—Henry T. Brendzel

(57) ABSTRACT

Better reproduction of sound is achieved analyzing audio signals for perceptual soundfield imaging cues, and applying appropriate portions of the audio signal to a directional speaker and to a diffusing speaker, based on the analyzed audio signals. Specifically, the audio signal is applied to a critical band filter bank, and at the higher frequencies a detector detects leading edges in the signal's envelope. Concurrently, the audio signal is applied to a delay element followed by a reconstruction filter bank. The output of each filter in the reconstruction filter bank is applied to a one-input/two-outputs soft switch (single pole, double throw) that is controlled by one or more of the detectors. One output of the switch is applied to a directional speaker, and the other output of the switch is applied to a diffusing speaker.

3 Claims, 1 Drawing Sheet

PERCEPTUAL SPEAKER DIRECTIVITY

REFERENCE TO A RELATED APPLICATION

This application claims priority from a provisional application No. 60/156,483 filed Sep. 28, 1999.

BACKGROUND OF THE INVENTION

This invention relates to processing of audio and, more particularly, to processing of audio for presentation to loudspeakers.

The spatial images of soundfields are mainly detected through interaural time differences (ITD) and interaural delay differences (ILD). For low frequency signals, i.e., below 500 Hz, synchronous binaural detection provides imaging cues. For signals above 2 kHz, where "synchronous" detection is not neurally possible, the ear switches from phase to envelope detection. Accordingly, at the higher frequencies the ILD and leading edges of the envelope provide the imaging cues. Between 500 Hz and 2 kHz, both systems contribute imaging cues, but sometimes those cues conflict.

When audio is recorded, both direct and indirect sound is captured by the microphones and converted to a composite electrical signal. To reproduce the sound, the electrical signals are converted to sound, but the prior art pays no attention to the sound field imaging cues that are contained in the signal. There is prior art, however, that applies some of the signal to a directional speaker, and applies the remaining signal to a diffusing speaker, but the ratio of the signals that are applied to the two different speakers is fixed, or manually adjustable. It is not sensitive to the signal characteristics.

SUMMARY OF THE INVENTION

An improvement in the art is realized by analyzing audio signals for perceptual soundfield imaging cues, and applying appropriate portions of the audio signal to a directional speaker and to a diffusing speaker, based on the analyzed audio signals. Specifically, the audio signal is applied to a critical band filter bank, and at the higher frequencies a detector detects leading edges in the signal's envelope. Concurrently, the audio signal is applied to a delay element followed by a reconstruction filter bank. The output of each filter in the reconstruction filter bank is applied to a one-input/two-outputs soft switch (single pole, double throw) that is controlled by one or more of the detectors. One output of the switch is applied to a directional speaker, and the other output of the switch is applied to a diffusing speaker.

DETAILED DESCRIPTION

Figure 1:
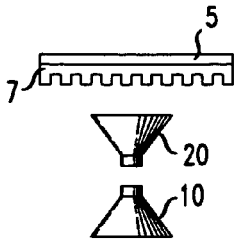
FIG. 1 shows a speaker arrangement that includes both a directional speaker, and a diffusing speaker.

FIG. 1 illustrates one embodiment of a speaker arrangement that has both a directional speaker and a diffusing speaker. Speakers 10 and 20 are placed adjacent to surface 5, with speaker 20 facing surface 5, and speaker 10 facing away from surface 5. Surface box 5 includes diffusing element 7. This provides for a direct sound field from speaker 10, and a diffused sound field from speaker 20.

Figure 2:
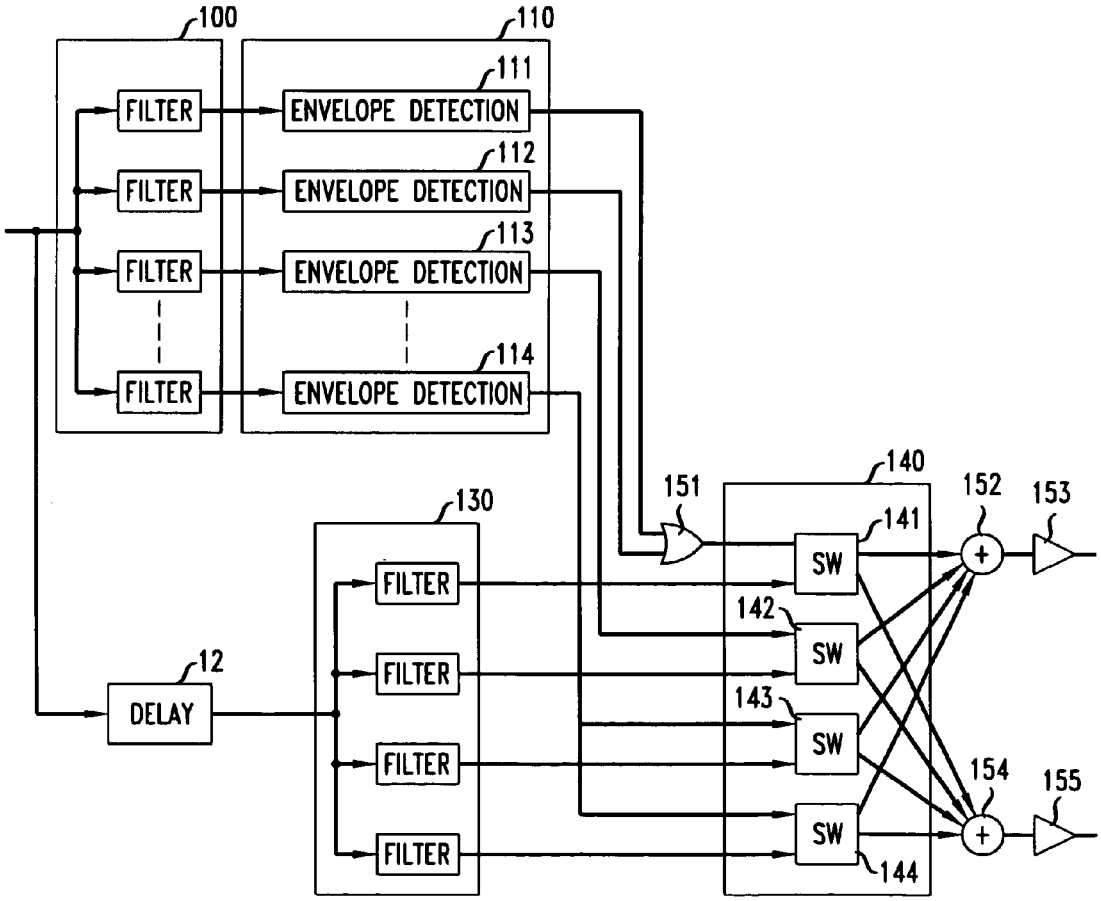
FIG. 2 presents a block diagram of an arrangement for processing an audio signal and applying it to the two types of speakers in the speaker arrangement.

FIG. 2 presents a block diagram of the processing associated with the principles disclosed herein, where block 100 is an approximate critical band filter bank. Block 100 is an element that is well known in the art and is described, for example, in "Micomechanical Models of the Cochlea" by J. Allen et al, *Physics Today*, July 1992, pp. 40–47. There are about 25 filters in that filter bank, covering the audio range, but for purposes of the FIG. 1 embodiment, only the filters that cover frequencies above 2 kHz are employed, leaving about 15 filters. The output of each of the filters in bank 100 is applied to an envelope detector circuit in detector bank 110. Each detector circuit comprises a conventional detector that can be implemented with a rectifier and a low pass filter, and some additional simple processing. In particular, each detector circuit develops a signal x that corresponds to the envelope of the signal applied to the detector, and determines whether the equation $$x(t-t_0)>\alpha\cdot x(t)$$

is satisfied, where $\alpha$ is greater than 1 and varies with frequency. If the equation is satisfied, the detector concludes that the signal's power in the band corresponding to the band of the filter in bank 100 to which the detector is connected has increased significantly within the $(t-t_0)$ time interval, and should be applied to a directional speaker, rather than to a diffusing speaker. Effectively, therefore, the detector monitors of change in the envelope of the input signal, and when it detects an "attack," is calls for outputting of the sound through directional speaker 10. As soon as the "attack" subsides, the detector initiates a switch back to diffusing speaker 20.

The output of each detector designates whether a certain frequency in the audio signal that is applied to element 100 should be sent to directional speaker 10 or to diffusing speaker 20. However, the switching of a signal from one speaker to another speaker should not be done instantaneously. Because it is desired to take an interval of time to switch a signal from one speaker to another speaker, and since it is desired to complete the switch at the beginning of the audio signal interval when imaging cues are present (i.e., during the "attack"), it is necessary to introduce a delay that corresponds to the switching interval plus the processing time between the input at block 100 and the output of detectors in block 110. This delay is provided by element 12, which precedes invertible filter bank 130 that contains approximately 32 filters of equal bandwidth, covering the audio range. Filter bank 130 is fairly conventional. An illustrative embodiment of such a filter is presented in "Tight Weyl-Heisenberg Frames in $l^2(Z)$" by Z.Cvetkovic, *IEEE*, 1998, pp. 1356–159. The output of each filter in filter bank 130 is applied to a switch in switch bank 140. Each switch in bank 140 is a "Hann window" switch that, when told to switch a signal s from output B (diffusive speaker 20) to output A (directional speaker 10) does so in accordance with the function $$A=\left(0.5-0.5\cos\frac{\pi t}{L}\right)\cdot s,\quad \text{for } 0\le t\le L \text{ and}$$

$$A=1\qquad \text{for } t>L$$

where t is time and L is the switching interval of time, and $$B=\left(\sqrt{1-\left(0.5-0.5\cos\frac{\pi t}{L}\right)^2}\right)\cdot s\quad \text{for } 0\le t\le L \text{ and}$$

$$B=0\qquad t>L.$$

When switching back, the relevant equations of each switch are $$A = \left(0.5 + 0.5\cos\frac{\pi t}{L'}\right)\cdot s, \quad \text{for } 0 \le t \le L' \text{ and}$$
$$A = 0 \quad \text{for } t > L'$$

where L'>L.

$$B = \left(\sqrt{1 - \left(0.5 + 0.5\cos\frac{\pi t}{L'}\right)^2}\right)\cdot s \quad \text{for } 0 \le t \le L' \text{ and}$$
$$B = 1 \quad t > L'.$$

Each switch in bank 140 is controlled by one or more of the detectors in bank 110. More specifically, each detector covers a certain frequency band (that corresponds to the band of the filter in bank 100 to which it is connected) and, correspondingly, it controls the switches in bank 140 that cover the same frequency band. Thus, at the low frequencies two or three detectors may affect a given switch in switch bank 140 (illustratively, detectors 111 and 112 affect switch 142 through OR gate 151, whereas at the high frequencies one detector may affect a number of switches in switch bank 140 (illustratively, detector 114 affecting switches 143 and 144).

The A outputs of the switches in bank 140 are combined in adder 152, and applied to amplifier 153 whose output is coupled to directional speaker 10. The B outputs of the switches in bank 140 are combined in adder 154, and applied to amplifier 155 whose output is coupled to diffusing speaker 20.

The switching of a signal in a switch of bank 140 from output port B to output port A should be done quickly, for example, in less than 10 msec, the switching back (from port A to port B) advantageously be done more slowly, for example, four times as more slowly. The delay of element 120 corresponds to the faster switching time.

In connection with the switching delay, an issue can arise where, while switching a signal slowly from the directional speaker means (port A) to the diffusing speaker means (port B), a detector connected to the switch will require a switch of the signal to port A. In accordance with the FIG. 1 embodiment, the switch to port A (i.e., the fast switch) takes precedence.

In connection with the control of a switch by more than one of the detectors in bank 110, again the switch to port A (i.e., the fast switch) takes precedence and, therefore, all of the detector control signals that are applied to a switch are combined in an OR function, as illustrated by OR gate 151 (where a logic 1 corresponds to a directive to switch the input signal to port A).

What is claimed is:

1. Apparatus responsive to an audio signal comprising:

a detector responsive to said audio signal; and a switch arrangement responsive to said audio signal and to control signals developed by said detector, for diverting some or all of said audio signal to a first output port adapted for connection to a directional speaker, and diverting remainder of said audio signal to a second output port adapted for connection to a diffusing speaker where said detector comprises:

a filter bank, where each filter in said filter bank is responsive to said audio signal, and a plurality of detector elements, each responsive to an output signal of a different filter in said filter bank;

where each detector element of said plurality of detector elements detects whether $x(t-t_0)>\alpha\cdot x(t)$, where x(t) is the envelope of said audio signal at time t, $t_0$ is a selected delay time, and $\alpha$ is a constant.

2. Apparatus responsive to an audio signal comprising:

a detector responsive to said audio signal; and a switch arrangement responsive to said audio signal and to control signals developed by said detector, for diverting some or all of said audio signal to a first output port adapted for connection to a directional speaker, and diverting remainder of said audio signal to a second output port adapted for connection to a diffusing speaker;

where said detector comprises:

a filter bank, where each filter in said filter bank is responsive to said audio signal, and a plurality of detector elements, each responsive to an output signal of a different filter in said filter bank;

where said switch arrangement comprises:

a filter module responsive to said audio signal, for developing a plurality of output signals, each covering a different band of frequencies, a bank of switch elements, each switch element of said bank of switch elements having a control port, one signal input, an A output and a B output, with said one signal input of each switch element in said bank of switch elements being responsive to a different output signal of said plurality of output signal:

a first combiner, for combining output signals from said A output of said switch elements in said bank of switch elements, to form a combined first signal that is applied to said first output port of said apparatus, and a second combiner, for combining output signals from said B output of said switch elements in said bank of switch elements, to form a combined second signal that is applied to said second output port of said apparatus;

where the control port each switch element is responsive to one or more outputs of said plurality of detector elements; and where each switch element, when switching signals at said signal input to said A output, switches in accordance with the equation $$A = \left(0.5 - 0.5\cos\frac{\pi t}{L}\right)\cdot s, \quad \text{for } 0 \le t \le L \text{ and}$$
$$A = 1 \quad \text{for } t > L,$$

where A is the signal at the A output, t is time, L is a selected constant, and s is the signal being switched.

3. The apparatus of claim 2 where said filter module comprises a delay element and a filter bank, where said delay element provides a delay that is related to said selected constant L.

* * * * *